US012359400B2

(12) United States Patent
Indoh

(10) Patent No.: US 12,359,400 B2
(45) Date of Patent: Jul. 15, 2025

(54) EXCAVATOR

(71) Applicant: SUMITOMO HEAVY INDUSTRIES, LTD., Tokyo (JP)

(72) Inventor: Masahito Indoh, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 593 days.

(21) Appl. No.: 17/649,942

(22) Filed: Feb. 4, 2022

(65) Prior Publication Data

US 2022/0154426 A1 May 19, 2022

Related U.S. Application Data

(63) Continuation of application No. PCT/JP2020/029899, filed on Aug. 4, 2020.

(30) Foreign Application Priority Data

Aug. 5, 2019 (JP) ..... 2019-143630

(51) Int. Cl.
*E02F 9/22* (2006.01)
*E02F 3/32* (2006.01)
(Continued)

(52) U.S. Cl.
CPC ..... *E02F 9/2235* (2013.01); *E02F 3/32* (2013.01); *E02F 3/435* (2013.01); *E02F 9/2037* (2013.01); *E02F 9/2267* (2013.01); *E02F 9/2296* (2013.01)

(58) Field of Classification Search
CPC . E02F 9/2235; E02F 3/32; E02F 3/435; E02F 9/2037; E02F 9/2267; E02F 9/2296;
(Continued)

(56) References Cited

U.S. PATENT DOCUMENTS

2006/0136110 A1* 6/2006 Casey ..... E02F 3/84 702/56
2017/0089040 A1* 3/2017 Tsukamoto ..... G10L 17/22
(Continued)

FOREIGN PATENT DOCUMENTS

CN 105971042 A * 9/2016 ..... E02F 3/32
JP H07-113250 5/1995
(Continued)

OTHER PUBLICATIONS

International Search Report for PCT/JP2020/029899 mailed on Oct. 27, 2020.

*Primary Examiner* — Thomas C Lee
*Assistant Examiner* — Michael Tang
(74) *Attorney, Agent, or Firm* — IPUSA, PLLC

(57) ABSTRACT

An excavator according to an embodiment of the present disclosure includes a lower traveling structure, an upper swing structure mounted on the lower traveling structure, a hydraulic driving motor configured to move the lower traveling structure, and a controller including a memory and a processor coupled to the memory and configured to control the hydraulic driving motor, and detect vibration of the upper swing structure and reduce variation of a command value for driving the hydraulic driving motor based on a mode of the vibration.

6 Claims, 7 Drawing Sheets

(51) Int. Cl.
*E02F 3/43* (2006.01)
*E02F 9/20* (2006.01)

(58) Field of Classification Search
CPC ..... E02F 9/2207; E02F 9/2228; E02F 9/2253; E02F 9/2012; E02F 3/28; E02F 3/36; E02F 9/00; E02F 9/08; E02F 9/121; E02F 9/20; E02F 9/2083; E02F 9/22; G01P 15/02; G05B 11/01; B60Y 2200/412
USPC ..... 700/280
See application file for complete search history.

(56) References Cited

U.S. PATENT DOCUMENTS

| | | | | |
|---|---|---|---|---|
| 2017/0107697 | A1 | 4/2017 | Kawashima | |
| 2018/0119386 | A1 | 5/2018 | Kobayashi et al. | |
| 2020/0024831 | A1 | 1/2020 | Okada et al. | |
| 2020/0189722 | A1* | 6/2020 | Duffy | B64D 27/24 |
| 2020/0240114 | A1* | 7/2020 | Yamamoto | E02F 9/2285 |

FOREIGN PATENT DOCUMENTS

| | | |
|---|---|---|
| JP | H08-105076 | 4/1996 |
| JP | 2004-340259 | 12/2004 |
| JP | 3730801 | 1/2006 |
| JP | 2010-248867 | 11/2010 |
| JP | 2016-205104 | 12/2016 |
| WO | 2016/002850 | 1/2016 |
| WO | 2018/180555 | 10/2018 |
| WO | 2019/078077 | 4/2019 |

* cited by examiner

EXCAVATOR

CROSS-REFERENCE TO RELATED APPLICATIONS

This application is a continuation of International Application No. PCT/JP2020/029899, filed on Aug. 4, 2020 and designating the U.S., which claims priority to Japanese Patent Application No. 2019-143630 filed on Aug. 5, 2019. The contents of these applications are incorporated herein by reference in their entirety.

BACKGROUND OF THE INVENTION

1. Field of the Invention

The present disclosure relates to an excavator.

2. Description of the Related Art

Conventionally, excavators with a hydraulic motor for driving are known.

However, the above-described excavators do not have a configuration controlling against adverse effects, in which vibration generated during driving causes the operator's body to shake, the driving operation by the operator. Therefore, the operator's driving operations may become unstable during driving the shovel.

In consideration of the above, instability of the operator's driving operations during driving is desired to be controlled.

SUMMARY OF THE INVENTION

An excavator according to an embodiment of the present disclosure includes a lower traveling structure, an upper swing structure mounted on the lower traveling structure, a driving actuator configured to move the lower traveling structure, and a controller including a memory and a processor coupled to the memory and configured to control the driving actuator, and detect vibration of the upper swing structure and reduces variation of a command value for driving the driving actuator based on the vibration of the upper swing structure.

According to the above-described means, the instability of the operator's driving operations during driving can be controlled.

DESCRIPTION OF THE EMBODIMENTS

Figure 1:
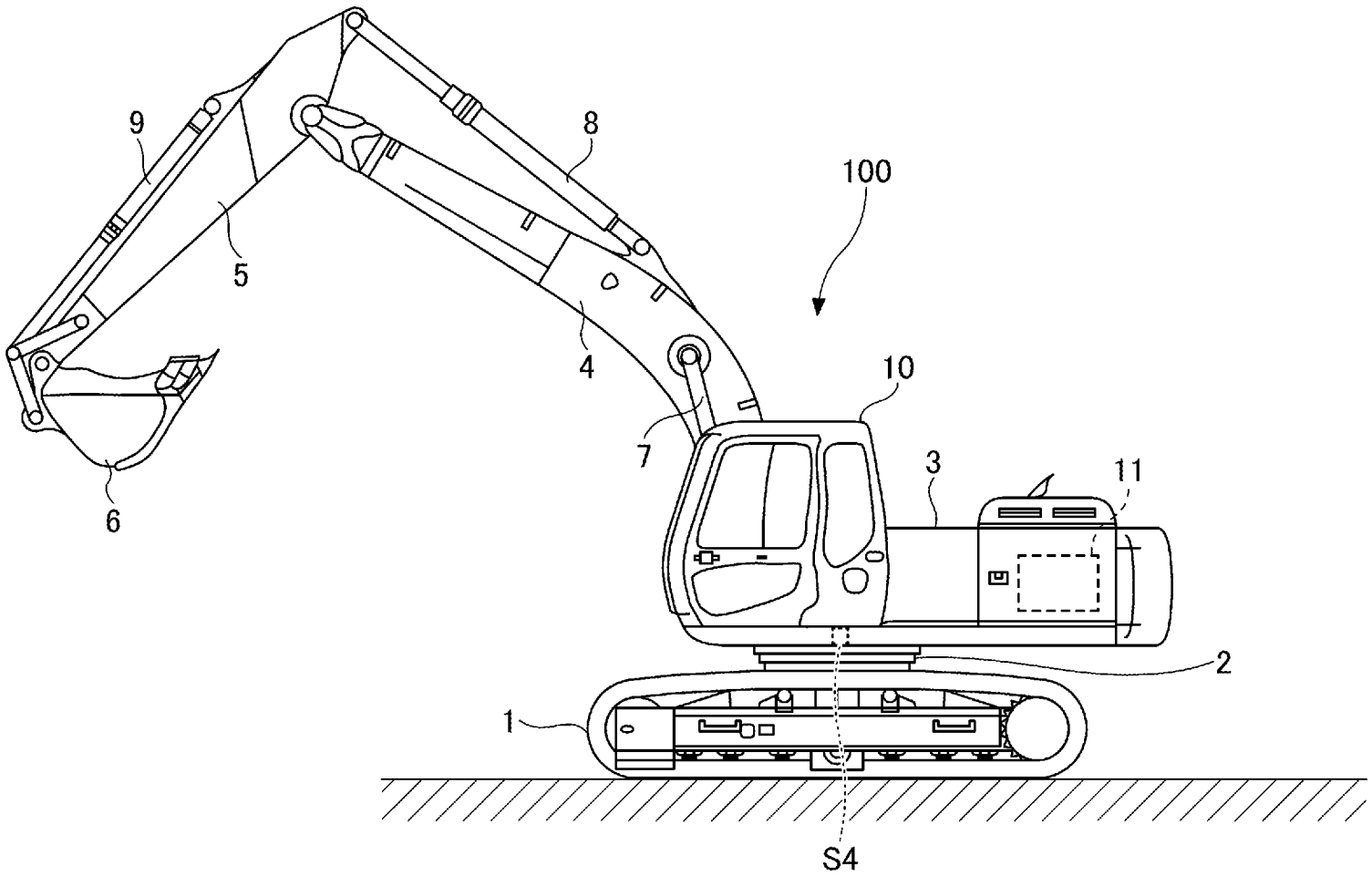
FIG. 1 is a side view of an excavator according to an embodiment of the present disclosure.

First, a shovel (an excavator 100) as a construction machine according to an embodiment of the present disclosure will be described with reference to FIG. 1. FIG. 1 is a side view of the excavator 100. A lower traveling structure 1 of the excavator 100 illustrated in FIG. 1 is installed with an upper swing structure 3 through a swing mechanism 2. A boom 4 as a working element is attached to the upper swing structure 3. An arm 5 as a working element is attached to the tip of the boom 4, and a bucket 6 as a working element and an end attachment is attached to the tip of the arm 5. The boom 4 is driven by a boom cylinder 7. The arm 5 is driven by an arm cylinder 8. The bucket 6 is driven by a bucket cylinder 9. The upper swing structure 3 includes a cabin 10 and a power source, such as an engine 11. The inertial sensor S4 is attached to the upper swing structure 3.

The inertial sensor S4 is configured to measure a motion of the excavator 100. The inertial sensor S4 is, for example, a hexaxial inertial measurement unit and is configured to measure angular velocity around the front-rear axis of the upper swing structure 3, angular velocity around the left-right axis of the upper swing structure 3, angular velocity around the vertical axis (swivel axis) of the upper swing structure 3, acceleration of the upper swing structure 3 in the front-rear axis direction, acceleration of the upper swing structure 3 in the left-right axis direction, and acceleration of the upper swing structure 3 in the vertical axis direction. The front-rear axis and the left-right axis of the upper swing structure 3 are perpendicular to each other at the center of the excavator, which is a point on the pivot axis of the excavator 100, for example. However, the inertial sensor S4 may be configured to measure data for at least one of the six axes. In the present embodiment, the inertial sensor S4 includes a combination of a 3-axis acceleration sensor and a 3-axis gyro sensor.

The inertial sensor S4 may be configured to detect, for example, a tilt of the upper swing structure 3 with respect to a predetermined plane, such as a virtual horizontal plane. In the present embodiment, the acceleration sensor constituting the inertial sensor S4 is configured to detect a tilt angle (roll angle) around the front-rear axis, a tilt angle (pitch angle) around the left-right axis, and a tilt angle (yaw angle) around the swivel axis.

The inertial sensor S4 may be configured to detect swing angular velocity of the upper swing structure 3. In the present embodiment, the gyro sensor constituting the inertial sensor S4 is configured to detect the swing angular velocity and the swing angle of the upper swing structure 3. The inertial sensor S4 may include a resolver or rotary encoder, or the like for detecting the swing angular velocity of the upper swing structure 3.

Figure 2:
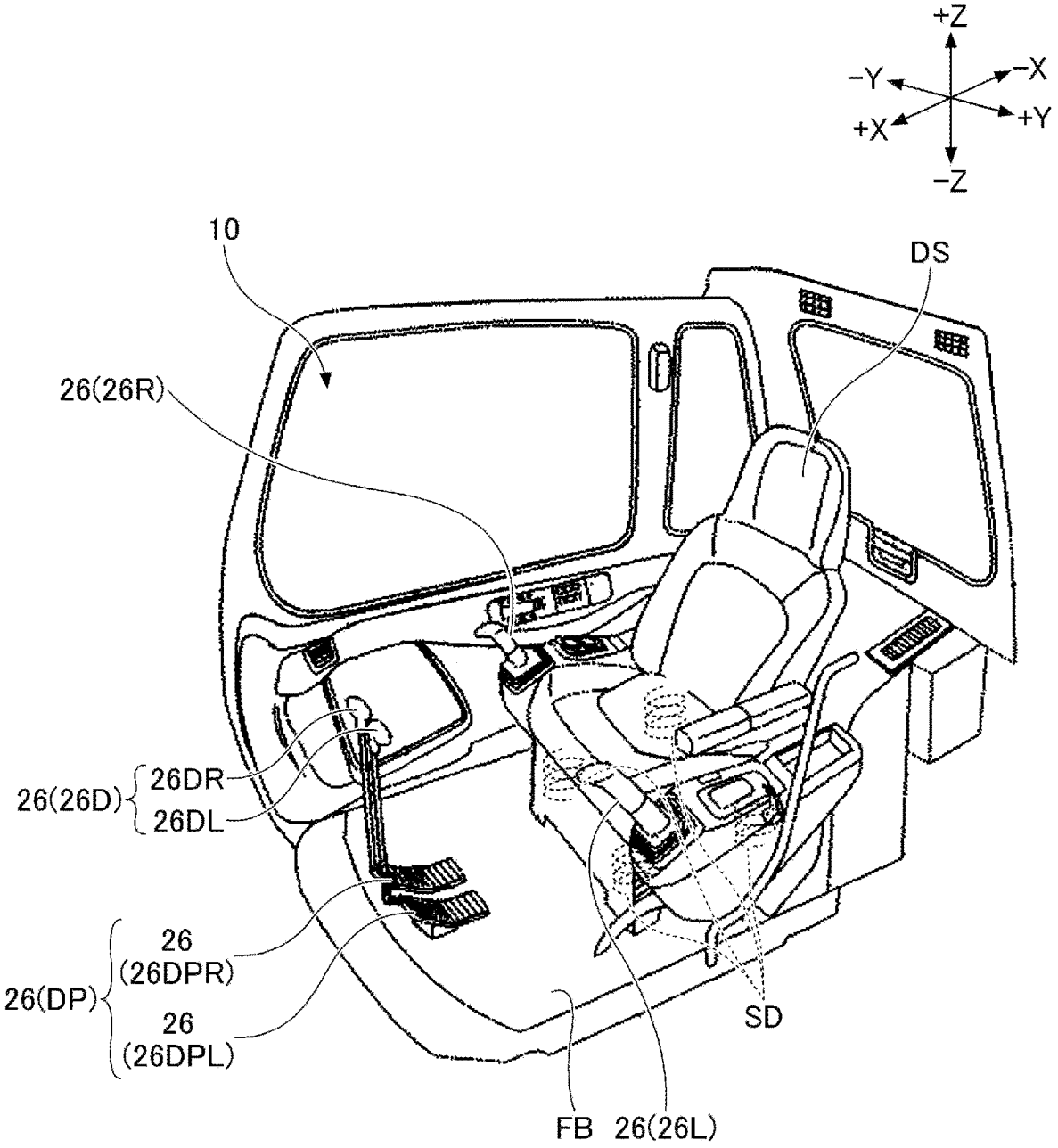
FIG. 2 is a perspective view of a cabin illustrating an interior structure of the cabin.

FIG. 2 is a perspective view of a cabin 10 illustrating the interior structure of the cabin 10. An operation device 26 and a driver's seat DS are mainly disposed in the interior of the cabin 10.

The driver's seat DS is located in the center of the cabin 10 and mounted on a floor board FB via a sheet damper SD. That is, the driver's seat DS is configured so as not to directly transmit vibrations associated with the operation of the excavator 100 to the operator for the purpose of maintaining the comfort of the operator. The sheet damper SD is, for example, composed of a spring or the like.

The operation device 26 is a device used by an operator for operating an actuator. The actuator includes at least one of a hydraulic actuator and an electric actuator. In the present embodiment, the operation device 26 includes a left operation lever 26L, a right operation lever 26R, a driving (i.e., traveling) lever 26D, and a driving (i.e., traveling) pedal 26DP. The actuator includes the boom cylinder 7, the arm cylinder 8, the bucket cylinder 9, a hydraulic driving (i.e., traveling) motor 20 (see FIG. 3), and a hydraulic swivel motor 2A (see FIG. 3) as a hydraulic actuator. The hydraulic driving motor 20 is an example of a driving (i.e., traveling) actuator and includes a left hydraulic driving (i.e., traveling) motor 20L and a right hydraulic driving i.e., traveling) motor 20R. The driving actuator may be a driving (i.e., traveling) motor generator.

The left operation lever 26L is a device configured to be operated by the operator's left hand to move the arm cylinder 8 and the hydraulic swivel motor 2A, and is mounted on the driver's seat DS on the left side of the driver's seat DS.

The right operation lever 26R is a device configured to be operated by the operator's right hand to move the boom cylinder 7 and the bucket cylinder 9. The right operation lever 26R is mounted on the driver's seat DS on the right side of the driver's seat DS.

The driving lever 26D is an example of a driving (i.e., traveling) operation device used by the operator for operating the hydraulic driving motor 20 and is mounted on the floor board FB on the front side of the driver's seat DS. Typically, an operator can move the excavator 100 forward by tilting the driving lever 26D forward, and backward by tilting the driving lever 26D backward (towards the operator).

Specifically, the driving lever 26D includes a left driving (i.e., traveling) lever 26DL and a right driving (i.e., traveling) lever 26DR mounted independently of each other to the floor board FB. The left driving lever 26DL is a device configured to be operated by the operator's left hand to move the left hydraulic driving motor 20L and the right driving lever 26DR is a device configured to be operated by the operator's right hand to move the right hydraulic driving motor 20R.

The driving pedal 26DP is another example of a driving operation device used by the operator for operating the hydraulic driving motor 20 and mounted on the floor board FB in front of the driver's seat DS. The drive pedal 26DP is configured to interlock with the driving lever 26D. Specifically, the driving pedal 26DP includes a left driving pedal 26DPL and a right driving pedal 26DPR. The left driving pedal 26DPL is a device configured to operate the left hydraulic driving motor 20L by the left foot, and the right driving pedal 26DPR is a device configured to operate the right hydraulic driving motor 20R by the right foot.

As illustrated in FIG. 2, the driver's seat DS is mounted on the floor board FB through the sheet damper SD, whereas the driving lever 26D is mounted directly on the floor board FB. Therefore, when the excavator 100 is driving on rough terrain, shaking (vibration mode) of the driver's seat DS may be different from the shaking (vibration mode) of the floor board FB (driving lever 26D). The same applies to the driving pedal 26DP. This difference in the way of shaking tends to be greater as the vibration damping property of the sheet damper SD increases, that is, when the shaking of the cabin 10 is not readily to be transmitted to the operator sitting on the driver's seat. When the shaking of the operator sitting on the driver's seat DS is different from the shaking of the driving lever 26D, the shaking of the operator's hand placed on the gripping section of the driving lever 26D is also different from the shaking the driving lever 26D. Therefore, the difference in the way of shaking may destabilize the operation of the driving lever 26D. This destabilization may also become more conspicuous as the operator is smaller. This is because the smaller the operator, the worse the foot placement on the floor board FB. Further, the difference in the way of shaking may become more conspicuous as the weight of the operator is lighter. The destabilization of the operation of the driving lever 26D can cause a greater shaking of the excavator 100. The excavator 100 is configured to prevent unstable operation of the driving lever 26D by the operator, which will be described below.

Figure 3:
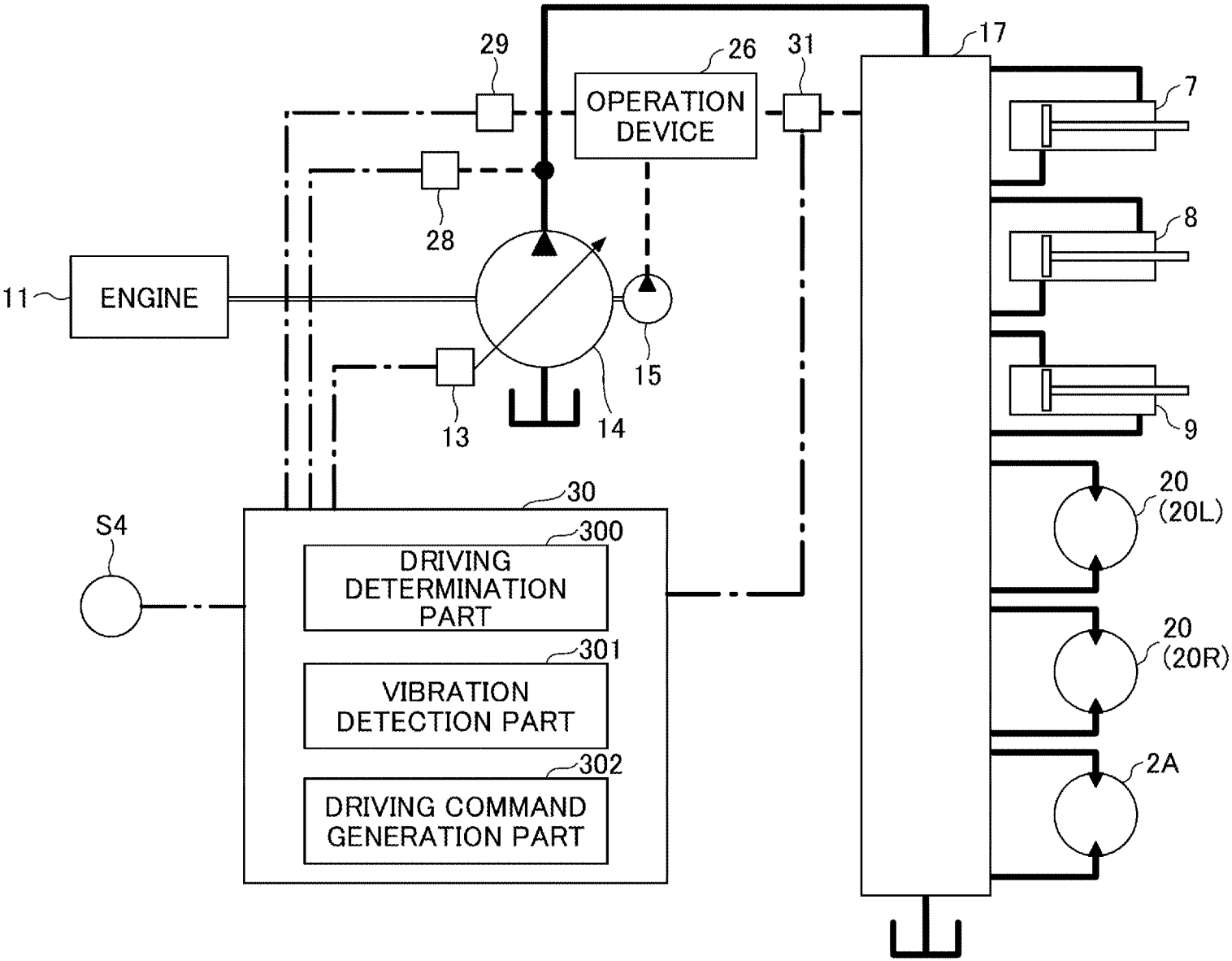
FIG. 3 is a diagram illustrating an example configuration of a basic system installed in the excavator of FIG. 1.
Figure 4:
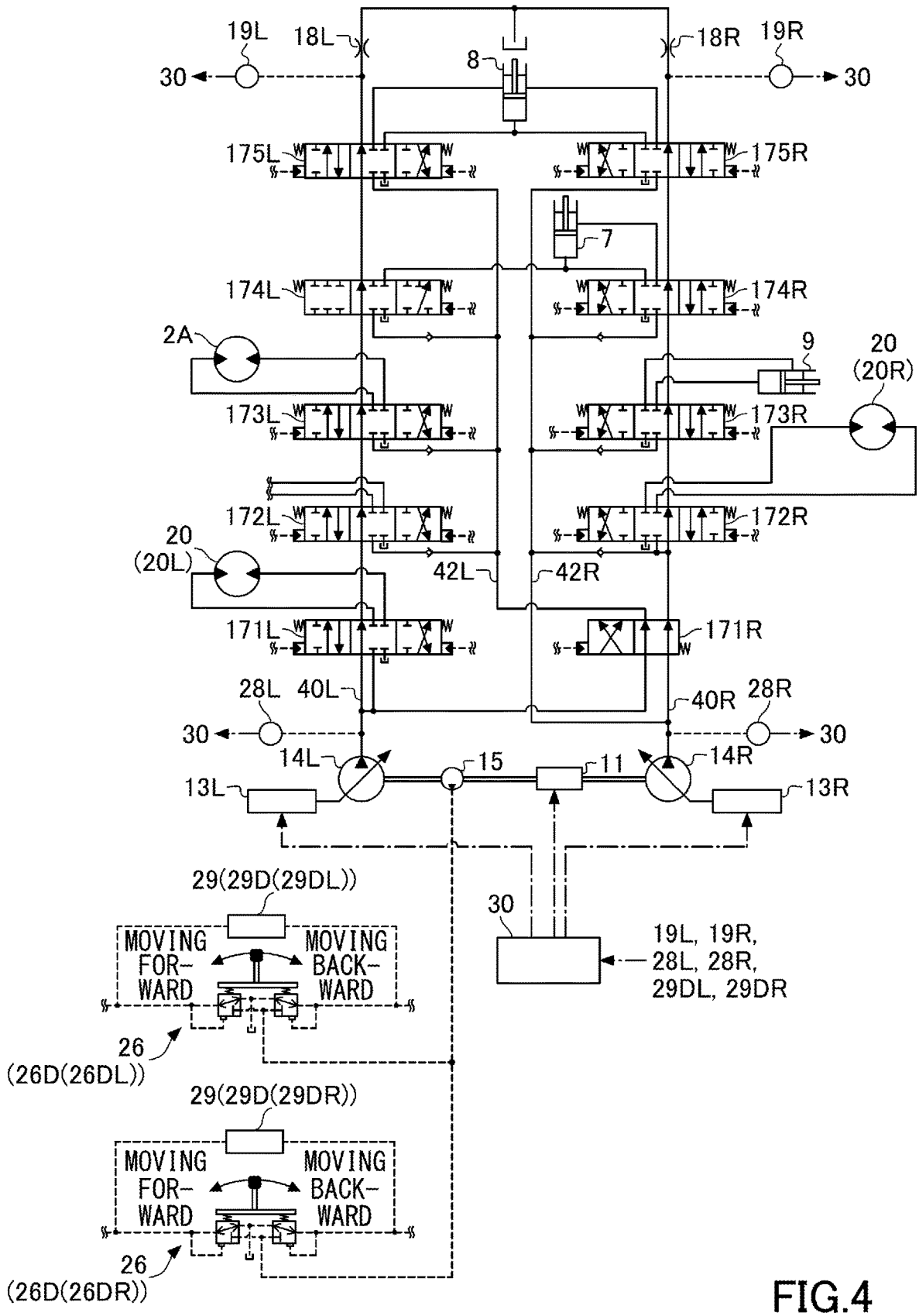
FIG. 4 is a diagram illustrating an example configuration of a hydraulic system installed in the excavator of FIG. 1.
Figure 5:
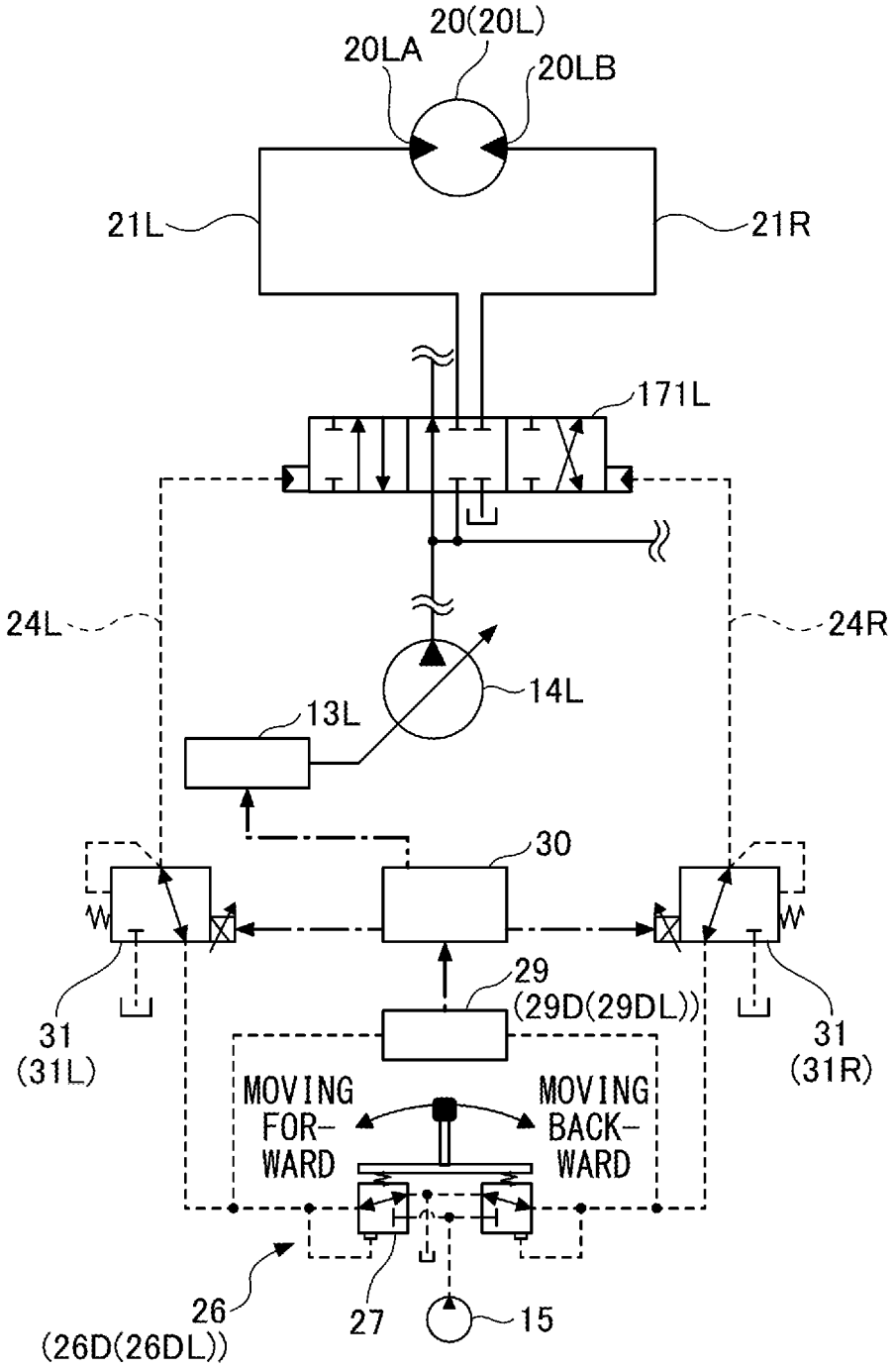
FIG. 5 is a diagram illustrating an example configuration of a part relating to a hydraulic motor for driving in the hydraulic system of FIG. 4.

Next, an example configuration of a basic system and a hydraulic system installed in the excavator 100 will be described with reference to FIG. 3 to FIG. 5. FIG. 3 is a diagram illustrating an example configuration of the basic system installed in the excavator 100 of FIG. 1. FIG. 4 is a diagram illustrating an example configuration of the hydraulic system installed in the excavator 100 of FIG. 1. FIG. 5 is a diagram illustrating an example configuration of a part relating to the hydraulic driving motor 20 for driving in the hydraulic system of FIG. 4.

In FIG. 3 to FIG. 5, a mechanical power transmission line, a hydraulic oil line, a pilot line, and an electric control line are indicated by a double line, a thick solid line, a dashed line, and a long dash-dot line, respectively.

The basic system of the excavator 100 includes an engine 11, a regulator 13, a main pump 14, a control pump 15, a control valve 17, the operation device 26, a discharge pressure sensor 28, an operation pressure sensor 29, a controller 30, and a solenoid valve 31, as illustrated in FIG. 3.

The engine 11 is a driving source of the excavator. In the present embodiment, the engine 11 is, for example, a diesel engine as an internal combustion engine operated to maintain a predetermined rotation speed. An output shaft of the engine 11 is coupled to the respective input shafts of the main pump 14 and the control pump 15.

The regulator 13 is configured to control the discharge amount (displacement amount) of the main pump 14. In the present embodiment, the regulator 13 controls the discharge amount (displacement amount) of the main pump 14 by adjusting the tilt angle of the main pump 14 in response to a control command from the controller 30.

The main pump 14 is configured to supply hydraulic oil to the control valve 17 via the hydraulic oil line. In the present embodiment, the main pump 14 is a swash plate variable displacement hydraulic pump.

The control pump 15 is configured to supply hydraulic oil to a hydraulic control device including the operation device 26 via the pilot line. In the present embodiment, the control pump 15 is a fixed displacement hydraulic pump. However, the control pump 15 may be omitted. In this case, the function performed by the control pump 15 may be implemented by the main pump 14. That is, the main pump 14 may be provided with a function of supplying hydraulic oil to the control valve 17, as well as a function of supplying hydraulic oil to the operation device 26 after the pressure of the hydraulic oil is lowered by a squeeze or the like.

The control valve 17 is a hydraulic controller which controls the hydraulic system in the excavator. In the present embodiment, the control valve 17 includes multiple control valves for controlling the flow of the hydraulic oil discharged by the main pump 14. The control valve 17 is configured to selectively supply the hydraulic oil discharged by the main pump 14 to one or more hydraulic actuators via the control valves. The control valves are configured to control the flow rate of hydraulic oil flowing from the main pump 14 to the hydraulic actuator and the flow rate of hydraulic oil flowing from the hydraulic actuator to the hydraulic oil tank.

The operation device 26 is a device used by the operator for operating the actuator. In the present embodiment, the operation device 26 is hydraulic and supplies hydraulic oil discharged by the control pump 15 to the pilot ports of the control valves corresponding to each of the hydraulic actuators via the pilot line. The pressure of the hydraulic oil supplied to each of the pilot ports (hereinafter referred to as "pilot pressure") is the pressure according to the operation direction and the operation amount of the lever or the pedal constituting the operation device 26 corresponding to each of the hydraulic actuators. However, the operation device 26 may be electrically powered.

The discharge pressure sensor 28 is a sensor for detecting discharge pressure of the main pump 14 and outputs the detected value to the controller 30.

The operation pressure sensor 29 is configured to detect the operator's operation content using the operation device 26. In the present embodiment, the operation pressure sensor 29 is a pressure sensor that detects the operation direction and the operation amount of the lever or the pedal constituting the operation device 26 corresponding to each of the hydraulic actuators in the form of pressure and outputs the detected value to the controller 30. The operation content of the operation device 26 may be detected using the output of devices other than a pressure sensor, such as at least one of an angle sensor, an acceleration sensor, an angular velocity sensor, a resolver, a voltmeter, and an ammeter. That is, the operation amount of the operation device 26 may be expressed not only by the operation pressure but also by at least one of operation angle, a value obtained by integrating the operation acceleration twice, an integral of the operation angular velocity, a voltage value, and a current value.

The controller 30 is a controller for controlling the excavator 100. In the present embodiment, the controller 30 is constituted of a computer including a Central Processing Unit (CPU), a volatile storage device, a non-volatile storage device, and the like. The controller 30 reads a program corresponding to a functional element such as a driving (i.e., traveling) determination part 300, a vibration detection part 301, and a driving (i.e., traveling) command generation part 302.

The controller 30 performs a calculation by a functional element, for example, based on at least one output of the discharge pressure sensor 28 and the operation pressure sensor 29, and the like. The controller 30 outputs a control command according to the calculation result to the solenoid valve 31 or the like.

The solenoid valve 31 is configured to operate in accordance with a control command from the controller 30. In the present embodiment, the solenoid valve 31 is a pressure reducing valve disposed in an oil path connecting the operation device 26 and the pilot port of the corresponding control valve in the control valve 17. The solenoid valve 31 is configured to be able to adjust the pilot pressure applied to the pilot port of the corresponding control valve.

As illustrated in FIG. 4, the hydraulic system installed in the excavator 100 circulates the hydraulic oil from a left main pump 14L driven by the engine 11 to the hydraulic oil tank via a left center bypass oil path 40L or a left parallel oil path 42L, and circulates the hydraulic oil from the right main pump 14R driven by the engine 11 to the hydraulic oil tank via a right center bypass oil path 40R or a right parallel oil path 42R. The left main pump 14L and the right main pump 14R correspond to the main pump 14 of FIG. 3.

The left center bypass oil path 40L is a hydraulic oil line through control valves 171L to 175L disposed in the control valve 17. The right center bypass oil path 40R is a hydraulic oil line through control valves 171R to 175R disposed in the control valve 17.

The control valve 171L is a spool valve that supplies hydraulic oil discharged by the left main pump 14L to the left hydraulic driving motor 20L and switches the flow of the hydraulic oil in order to discharge the hydraulic oil discharged by the left hydraulic driving motor 20L to the hydraulic oil tank.

The control valve 171R is a spool valve used as a straight travel control valve. The control valve 171R can switch the flow of the hydraulic oil so that the hydraulic oil is supplied from the left main pump 14L to each of the left hydraulic driving motor 20L and the right hydraulic driving motor 20R in order to improve the straightness of the lower traveling structure 1. Specifically, when the hydraulic driving motor 20 and any other hydraulic actuator are operated simultaneously, the control valve 171R is switched to a first valve position so that the left main pump 14L can supply the hydraulic oil to both the left hydraulic driving motor 20L and the right hydraulic driving motor 20R. If none of the other hydraulic actuators are operated, the control valve 171R is switched to a second valve position so that the left main pump 14L can supply the hydraulic oil to the left hydraulic driving motor 20L and the right main pump 14R can supply the hydraulic oil to the right hydraulic driving motor 20R. FIG. 4 illustrates the state when the control valve 171R is in the second valve position.

The control valve 172L is a spool valve that supplies hydraulic oil discharged by the left main pump 14L to an optional hydraulic actuator and switches the flow of the hydraulic oil in order to discharge the hydraulic oil discharged by the optional hydraulic actuator to the hydraulic oil tank. The optional hydraulic actuator is, for example, a Grapple opening/closing cylinder.

The control valve 172R is a spool valve that supplies hydraulic oil discharged by the right main pump 14R to the right hydraulic driving motor 20R and switches the flow of the hydraulic oil in order to discharge the hydraulic oil discharged by the right hydraulic driving motor 20R to the hydraulic oil tank.

The control valve 173L is a spool valve that supplies hydraulic oil discharged by the left main pump 14L to the hydraulic swivel motor 2A and switches the flow of hydraulic oil in order to discharge the hydraulic oil discharged by the hydraulic swivel motor 2A to the hydraulic oil tank.

The control valve 173R is a spool valve that supplies hydraulic oil discharged by the right main pump 14R to the bucket cylinder 9 and discharges the hydraulic oil from the bucket cylinder 9 to the working oil tank.

The control valve 174L is a spool valve that supplies hydraulic oil discharged by the left main pump 14L to the boom cylinder 7 and switches the flow of the hydraulic oil in order to discharge the hydraulic oil in the boom cylinder 7 to the hydraulic oil tank. The control valve 174R is a spool valve that supplies hydraulic oil discharged by the right main pump 14R to the boom cylinder 7 and switches the flow of the hydraulic oil in order to discharge the hydraulic oil in the boom cylinder 7 to the hydraulic oil tank. In the present embodiment, the control valve 174L operates only when an operation in the upward direction of the boom 4 is performed, and does not operate when an operation in the downward direction of the boom 4 is performed.

The control valve 175L is a spool valve that supplies hydraulic oil discharged by the left main pump 14L to the arm cylinder 8 and switches the flow of the hydraulic oil in order to discharge the hydraulic oil in the arm cylinder 8 to the hydraulic oil tank. The control valve 175R is a spool valve that supplies hydraulic oil discharged by the right main pump 14R to the arm cylinder 8 and switches the flow of hydraulic oil in order to discharge the hydraulic oil in the arm cylinder 8 to the hydraulic oil tank.

The left parallel oil path 42L is a hydraulic oil line parallel to the left center bypass oil path 40L. The left parallel oil path 42L can supply hydraulic oil to a control valve located on the downstream side in the case where the flow of hydraulic oil through the center bypass oil path 40L is restricted or cut off by any of the control valves 171L to 174L. The right parallel oil path 42R is a hydraulic oil line parallel to the right center bypass oil path 40R. The right parallel oil path 42L can supply hydraulic oil to a control valve located on the downstream side in the case where the flow of hydraulic oil through the center bypass oil path 40R is restricted or cut off by any of the control valves 172R to 174R.

A left regulator 13L controls the discharge amount of the left main pump 14L by adjusting the tilt angle of the swash plate of the left main pump 14L in accordance with the discharge pressure of the left main pump 14L. A right regulator 13R controls the discharge amount of the right main pump 14R by adjusting the tilt angle of the swash plate of the right main pump 14R in accordance with the discharge pressure of the right main pump 14R. The left regulator 13L and the right regulator 13R correspond to the regulator 13 of FIG. 3. The left regulator 13L adjusts the tilt angle of the left main pump 14L to reduce the discharge amount, for example, when the discharge pressure of the left main pump 14L increases. Further, the right regulator 13R adjusts the tilt angle of the right main pump 14R to reduce the discharge amount, for example, when the discharge pressure of the right main pump 14R increases. This is to prevent the absorbed horsepower of the main pump 14, which is represented by the product of the discharge pressure and the discharge amount, from exceeding the output horsepower of the engine 11.

The driving operation device is an example of the operation device 26. In the present embodiment, the driving operation device includes a combination of the driving lever 26D and the driving pedal 26DP that interlock each other. The driving lever 26D includes a left driving lever 26DL and a right driving lever 26DR, and the driving pedal 26DP includes a left driving pedal 26DPL and a right driving pedal 26DPR.

The left driving lever 26DL is used to operate the left hydraulic driving motor 20L. The left driving lever 26DL uses the hydraulic oil discharged by the control pump 15 to apply pilot pressure to the pilot port of the control valve 171L in accordance with the operation amount. Specifically, the left driving lever 26DL causes the left pilot port of the control valve 171L to apply pilot pressure when operated in the forward operation direction, and the right pilot port of the control valve 171L to apply pilot pressure when operated in the backward operation direction. The same applies to the left driving pedal 26DPL.

The right driving lever 26DR is used to operate the right hydraulic driving motor 20L. The right driving lever 26DR uses the hydraulic oil discharged by the control pump 15 to apply pilot pressure to the pilot port of the control valve 172R in accordance with the operation amount. Specifically, the right driving lever 26DR causes the right pilot port of the control valve 172R to apply pilot pressure when operated in the forward operation direction, and the left pilot port of the control valve 172R to apply pilot pressure when operated in the backward operation direction. The same applies to the right driving pedal 26DPR.

A left discharge pressure sensor 28L and a right discharge pressure sensor 28R are examples of the discharge pressure sensor 28 of FIG. 3. The left discharge pressure sensor 28L detects the discharge pressure of the left main pump 14L and outputs the detected value to the controller 30. The right discharge pressure sensor 28R detects the discharge pressure of the right main pump 14R and outputs the detected value to the controller 30.

A driving operation pressure sensor 29D is an example of the operation pressure sensor 29 of FIG. 3 and includes a left driving operation pressure sensor 29DL and a right driving operation pressure sensor 29DR. The left driving operation pressure sensor 29DL detects the operator's operation content with respect to the left driving lever 26DL in the form of pressure and outputs the detected value to the controller 30. The right driving operation pressure sensor 29DR detects the operator's operation content with respect to the right driving lever 26DR in the form of pressure and outputs the detected value to the controller 30. The operation content is, for example, an operation direction, an operation amount (operation angle), and the like.

A boom operation lever, an arm operation lever, a bucket operation lever, and a swivel operation lever (neither of which is illustrated in the figure) are operation devices for operating the vertical movement of the boom 4, the opening and closing of the arm 5, the opening and closing of the bucket 6, and the swiveling of the upper swing structure 3, respectively. The operation devices, similar to the left driving lever 26DL, use the hydraulic oil discharged by the control pump 15 to apply pilot pressure in accordance with the operation amount of the lever to either the left or right pilot port of the control valve corresponding to each of the hydraulic actuators. The operation content for each of the operation devices is detected in a form of pressure by a corresponding operation pressure sensor and the detected value is output to the controller 30.

Hereinafter, a control process of negative control employed in the hydraulic system of FIG. 4 will be described. The following description relates to the control process of negative control of the left main pump 14L, but may also be applied to the negative control of the right main pump 14R.

The left center bypass oil path 40L includes a left throttle 18L between the hydraulic oil tank and the control valve 175L which is located on the most downstream side. The left throttle 18L restricts the flow of the hydraulic oil discharged by the left main pump 14L. The left throttle 18L produces a control pressure for controlling the left regulator 13L.

A left control pressure sensor 19L is configured to detect control pressure generated upstream of the left throttle 18L. Similarly, a right control pressure sensor 19R is configured to detect control pressure generated upstream of a right throttle 18R. In the present embodiment, the left control pressure sensor 19L and the right control pressure sensor 19R output the detected values to the controller 30.

The controller 30 outputs, for example, a control command according to the control pressure detected by the left control pressure sensor 19L to the left regulator 13L. The left regulator 13L controls the discharge amount of the left main pump 14L by adjusting the tilting angle of the swash plate of the left main pump 14L in accordance with the control command. Typically, the left regulator 13L decreases the discharge amount of the left main pump 14L as the control pressure is increased, and increases the discharge amount of the left main pump 14L as the control pressure is decreased.

If none of the hydraulic actuators are operated, the hydraulic oil discharged by the left main pump 14L passes through the left center bypass oil path 40L to the left throttle 18L. Then, the flow of the hydraulic oil discharged by the left main pump 14L increases the control pressure generated upstream of the left throttle 18L. As a result, the left regulator 13L reduces the discharge amount of the left main pump 14L to the allowable minimum discharge amount, and controls the pressure loss (pumping loss) when the discharged hydraulic oil passes through the left center bypass oil path 40L.

On the other hand, when any of the hydraulic actuators is being operated, the hydraulic oil discharged by the left main pump 14L flows into the hydraulic actuator to be operated via the control valve corresponding to the hydraulic actuator to be operated. Then, the flow of the hydraulic oil discharged by the left main pump 14L decreases or eliminates the amount reaching the left throttle 18L, thereby lowering the control pressure generated upstream of the left throttle 18L. As a result, the left regulator 13L increases the discharge amount of the left main pump 14L, circulates sufficient hydraulic oil to the hydraulic actuator to be operated, and ensures the driving of the hydraulic actuator to be operated.

According to the configuration described above, the hydraulic system of FIG. 4 can reduce wasted energy consumption in the left main pump 14L when none of the hydraulic actuators are operated. The wasted energy consumption includes the pumping loss caused by the hydraulic oil discharged by the left main pump 14L in the left center bypass oil path 40L. When the hydraulic actuator is being operated, the hydraulic system of FIG. 4 ensures that sufficient hydraulic oil is supplied from the left main pump 14L to the hydraulic actuator to be operated.

Next, an example configuration of a left driving pilot circuit will be described with reference to FIG. 5. FIG. 5 is a diagram illustrating an example configuration of a left driving pilot circuit.

The left driving pilot circuit is configured to transmit the pilot pressure generated by the left driving lever 26DL to the pilot port of the control valve 171L.

Specifically, the left driving pilot circuit is configured to connect the control valve 171L and a first port 20LA of the left hydraulic driving motor 20L by a hydraulic oil line 21L and to connect the control valve 171L and a second port 20LB of the left hydraulic driving motor 20L by a hydraulic oil line 21R.

When the left driving lever 26DL is operated in the forward operation direction, the hydraulic oil line 21L is connected to the left main pump 14L and the hydraulic oil line 21R is connected to the hydraulic oil tank. Therefore, the hydraulic oil discharged by the left main pump 14L flows into the first port 20LA of the left hydraulic driving motor 20L via the control valve 171L and the hydraulic oil line 21L. Then, the hydraulic oil flowing into the first port 20LA is returned to the hydraulic oil tank via the hydraulic oil line 21R and the control valve 171L after rotating the left hydraulic driving motor 20L in a forward manner. In this case, a left crawler constituting the lower traveling structure 1 is rotated in a forward manner by the left hydraulic driving motor 20L.

Meanwhile, when the left driving lever 26DL is operated in the backward operation direction, the hydraulic oil line 21R is connected to the left main pump 14L and the hydraulic oil line 21L is connected to the hydraulic oil tank. Therefore, the hydraulic oil discharged by the left main pump 14L flows into the second port 20LB of the left hydraulic driving motor 20L via the control valve 171L and the hydraulic oil line 21R. Then, the hydraulic oil flowing into the second port 20LB is returned to the hydraulic oil tank via the hydraulic oil line 21L and the control valve 171L after rotating the left hydraulic driving motor 20L in a reverse manner. In this case, the left crawler constituting the lower traveling structure 1 is reversely rotated by the left hydraulic driving motor 20L.

The control valve 171L is configured to move in accordance with a pilot pressure generated by the left driving lever 26DL. The left driving lever 26DL receives a supply of hydraulic oil from the control pump 15 and uses the hydraulic oil to generate pilot pressure for moving the control valve 171L.

When the operator tilts the left driving lever 26DL forward to rotate the left crawler, the left driving lever 26DL applies pilot pressure to the left pilot port of the control valve 171L by supplying the hydraulic oil via a pilot line 24L to the left pilot port of the control valve 171L. In the example of FIG. 5, a solenoid valve 31L is disposed on the pilot line 24L. Therefore, the controller 30 can, if necessary, adjust the pilot pressure generated by the left driving lever 26DL with the solenoid valve 31L to apply the adjusted pilot pressure to the left pilot port of the control valve 171L. The control valve 171L is moved to the right by the adjusted pilot pressure, then the hydraulic oil line 21L is connected to the left main pump 14L and the hydraulic oil line 21R is connected to the hydraulic oil tank.

When the operator tilts the left driving lever 26DL backward to reversely rotate the left crawler, the left driving lever 26DL applies pilot pressure to the right pilot port of the control valve 171L by supplying the hydraulic oil via a pilot line 24R to the left pilot port of the control valve 171L. In the example of FIG. 5, a solenoid valve 31R is disposed on the pilot line 24R. Therefore, the controller 30 can, if necessary, adjust the pilot pressure generated by the left driving lever 26DL with the solenoid valve 31R to apply the adjusted pilot pressure to the right pilot port of the control valve 171L. The control valve 171L is moved to the left by the adjusted pilot pressure, then the hydraulic oil line 21R is connected to the left main pump 14L and the hydraulic oil line 21L is connected to the hydraulic oil tank.

Next, the driving determination part 300, the vibration detection part 301, and the driving command generation part 302 are functional elements of the controller 30 which will be described.

The driving determination part 300 is configured to determine whether the excavator 100 is being driven (i.e., traveling). In the present embodiment, the driving determination part 300 is configured to determine whether the excavator 100 is being driven based on the output of the operation pressure sensor 29. Specifically, for example, when it is determined that the driving lever 26D is being operated based on the output of the driving operation pressure sensor 29D, the driving determination part 300 may determine that the excavator 100 is being driven, and when it is determined that the driving lever 26D is not being operated, the driving determination part 300 may determine that the excavator 100 is not being driven.

Alternatively, the driving determination part 300 may determine whether the excavator 100 is being driven based on an image captured by an imaging device mounted in the upper swing structure 3. Specifically, the driving determination part 300 may determine whether the excavator 100 is being driven based on a change in the display position of an image of a predetermined object in an image captured by a camera mounted on the upper swing structure 3.

The vibration detection part 301 is configured to detect vibration at a predetermined portion of the excavator 100. In the present embodiment, the vibration detection part 301 is configured to detect a mode of vibration of the cabin 10 based on the output of the inertial sensor S4. Specifically, the vibration detection part 301 may detect, for example, a change (a change in time) in the pitch angle of the upper swing structure 3 as a vibration of the cabin 10. Alternatively, the vibration detection part 301 may detect one of the variations (a change in time) of the roll angle, the yaw angle, acceleration in the front-rear axis direction, acceleration in the left-right axis direction, and acceleration in the vertical axis direction of the upper swing structure 3 as a vibration of the cabin 10. Alternatively, the vibration detection part 301 may detect at least two combinations of variations (a change in time) of the pitch angle, the roll angle, the yaw angle, the acceleration in the front-rear axis direction, the acceleration in the left-right axis direction, and the acceleration in the vertical axis direction of the upper swing structure 3 as a vibration of the cabin 10.

Further, the vibration detection part 301 is not required to detect the mode of vibration of the cabin 10 based on the output of the inertial sensor S4, but may detect the mode of vibration of the cabin 10 based on the output of a boom angle sensor, an arm angle sensor, and a bucket angle sensor, or the like other than the inertial sensor S4. The vibration detection part 301 can also detect the mode of vibration of the cabin 10 using at least one output of the boom angle sensor, the arm angle sensor, and the bucket angle sensor mounted on the attachment, because the attachment is not manipulated rigorously while the excavator 100 is being driven.

Alternatively, the vibration detection part 301 may be configured to detect the mode of vibration of the cabin 10 based on the output of a GNSS receiver as a positioning device mounted in the upper swing structure 3. In this case, the vibration detection part 301 may detect at least one of the variations (a change in time) of the latitude, longitude, and altitude of the upper swing structure (the cabin 10) as a vibration of the cabin 10.

Alternatively, the vibration detection part 301 may be configured to detect the vibration of the cabin 10 based on a combination of the output of the inertial sensor S4 and the output of the GNSS receiver.

Alternatively, the vibration detection part 301 may detect the mode of vibration of the cabin 10 based on a change in the display position of an image of a predetermined object in an image captured by a camera mounted on the upper swing structure 3.

Further, the vibration detection part 301 may be configured to detect a mode of vibration of the driver's seat DS based on the output of another inertial sensor mounted on the driver's seat DS (see FIG. 2).

The driving command generation part 302 is configured to generate a driving (i.e., traveling) command. The driving command generation part 302 generates a driving (i.e., traveling) command value, for example, based on an operation content of the driving operation device detected by the driving operation pressure sensor 29D. In the present embodiment, the driving command generation part 302 generates a left driving command value based on the operation content of the left driving lever 26DL detected by the left driving operation pressure sensor 29DL, and generates a right driving command value based on the operation content of the right driving lever 26DR detected by the right driving operation pressure sensor 29DR.

Then, the driving command generation part 302 outputs a control command corresponding to the left driving command value to the solenoid valve 31 and rotates the left hydraulic driving motor 20L in a desired rotational direction at a desired rotational speed. The same applies to a case of rotating the right hydraulic driving motor 20R.

Further, the driving command generation part 302 is configured to correct the driving command value when the driving determination part 300 has determined that the excavator 100 is being driven and a predetermined condition is satisfied.

The predetermined condition includes, for example, at least one of the following: increase and decrease of the driving command value is repeated a predetermined number or more times; increase and decrease of the acceleration in the front-rear axis direction of the upper swing structure 3 detected by the vibration detection part 301 is repeated a predetermined number or more times; and increase and decrease of the acceleration in the front-rear axis direction of the driver's seat DS detected by the vibration detection part 301 is repeated a predetermined number or more times.

Then, when the predetermined condition is satisfied, the driving command generation part 302 determines that the driving operation is unstable due to vibration associated with the driving (hereinafter, referred to as "driving vibration"), and corrects the driving command value generated for each predetermined control cycle to smooth the variation of the driving command value. The smoothing of the variation of the driving command value is implemented, for example, by applying a low pass filter or the like. However, the smoothing of the variation of the driving command value may be implemented by other methods such as limiting the rate of variation of the driving command value, setting the upper limit of the driving command value, setting the lower limit of the driving command value, applying a bandpass filter, or changing the control gain.

The driving command generation part 302 may be configured to correct the driving command value only when the continuous driving (i.e., traveling) time, which is a period that is determined to be driven by the driving determination part 300, exceeds a predetermined time. This is to ensure that the operator can reliably operate the fine operation of the driving operation device.

Figure 6A:
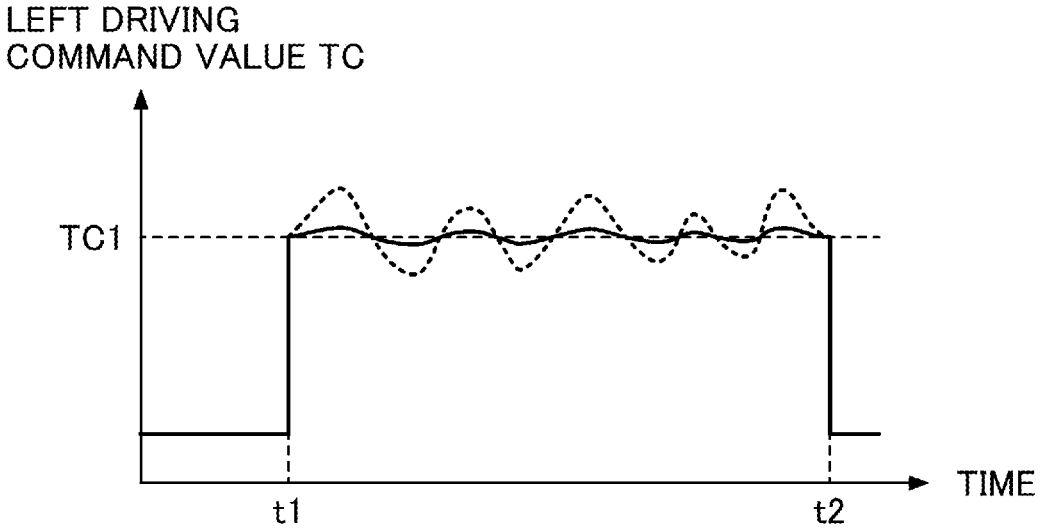
FIG. 6A is a diagram illustrating a temporal transition of a driving command value.
Figure 6B:
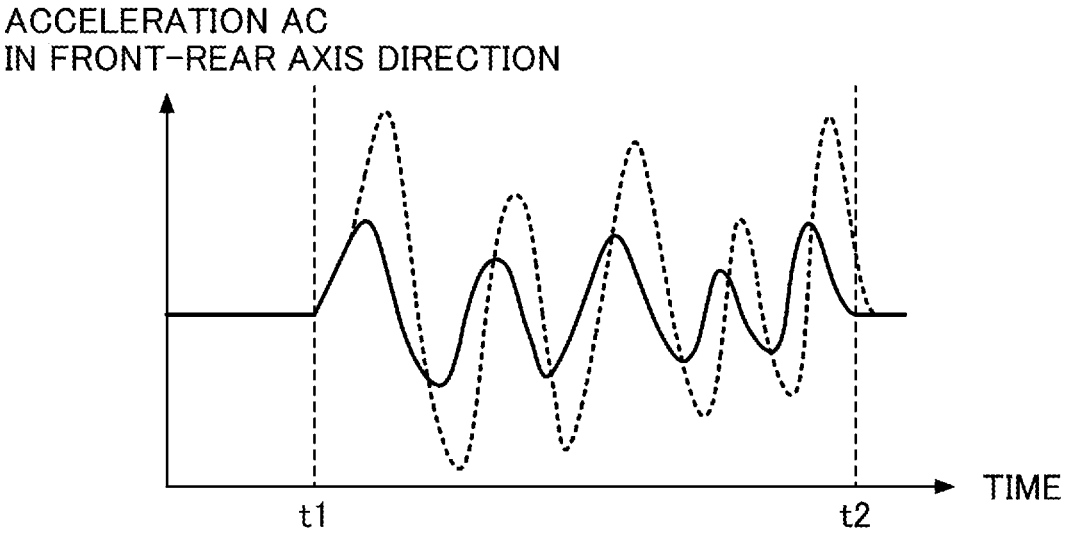
FIG. 6B is a diagram illustrating a temporal transition of acceleration in a front-rear axis direction of an upper swing structure.

Next, the effect of the correction of the driving command value will be described with reference to FIG. 6A and FIG. 6B. FIG. 6A and FIG. 6B illustrate a relationship between a temporal transition of the driving command value and a temporal transition of the acceleration in the front-rear axis direction of the upper swing structure 3. Specifically, FIG. 6A illustrates the temporal transition of a left driving command value TC for the left hydraulic driving motor 20L when the excavator 100 drives on rough terrain. The dotted line in FIG. 6A represents the time transition of the left driving command value TC before smoothing, and the solid line represents the time transition of the left driving command value TC after smoothing. FIG. 6B illustrates the temporal transition of an acceleration AC in the front-rear axis direction of the upper swing structure 3 when the excavator 100 drives on rough terrain. The dotted line in FIG. 6B represents the acceleration AC when the left driving command value TC is not smoothed, and the solid line represents the temporal transition of the acceleration AC when the left driving command value TC is smoothed.

At time t1, when the left driving lever 26DL and the right driving lever 26DR are manipulated in the forward operation direction with the same lever operation amount, the excavator 100 starts to move forward and the left driving command value TC increases to a value TC1 corresponding to the lever operation amount of the left driving lever 26DL. The same applies to the right driving command value (not illustrated). Further, in the example of FIG. 6B, the acceleration AC changes while repeatedly increasing and decreasing. This is because the upper swing structure 3 vibrates in the front-rear axis direction when driving on rough terrain.

When the upper swing structure 3 vibrates in the front-rear axis direction, the driver's seat DS mounted on the floor board FB of the cabin 10 through the sheet damper SD vibrates in a vibration mode different from the vibration mode of the cabin 10 rigidly connected to the upper swing structure 3. Therefore, an operator sitting on the driver's seat DS may vibrate at a phase different from the phase of the vibration of the driving lever 26D mounted on the floor board FB of the cabin 10. As a result, the left driving command value TC increases or decreases regardless of the operator's intention as illustrated by the dotted line in FIG. 6A, and the increase/decrease range of the acceleration AC becomes large as illustrated by the dotted line in FIG. 6B. This is because the vibration of the upper swing structure 3 inevitably caused by driving on rough terrain is amplified due to unstable operation (increase or decrease of lever operation amount) with respect to the driving lever 26D.

The controller 30 can prevent the expansion of the increase/decrease range of the acceleration AC by correcting the left driving command value TC as necessary. Specifically, when it is determined that the driving lever 26D is operated based on the output of the driving operation pressure sensor 29D, the driving determination part 300 of the controller 30 determines that the excavator 100 is being driven. Then, when the vibration detection part 301 detects that the increase or decrease of the acceleration AC is repeated more than a predetermined number of times, the driving command generation part 302 of the controller 30 determines that the predetermined condition is satisfied. Then, the driving command generation part 302 inputs the left driving command value TC generated based on the operation content of the left driving lever 26DL detected by the left driving operation pressure sensor 29DL to the low pass filter to smooth the left driving command value TC. As a result, the left driving command value TC is smoothed as illustrated by the solid line of FIG. 6A. Further, as illustrated by the solid line of FIG. 6A and FIG. 6B, the increase/decrease range of the acceleration AC becomes smaller than that in the case where the left driving command value TC as illustrated by the dotted line in FIG. 6B is not smoothed.

In this way, the controller 30 corrects the driving command value when operation of the driving lever 26D by the operator becomes unstable or is expected to become unstable so that disturbance of the driving command value due to unintended movement of the hand caused by vibration of the cabin 10 can be reduced or prevented.

At this time, the controller 30 may acquire at least one of operator information, setting information, and working environment information simultaneously and store the information together with the information related to the vibration. The controller 30 may use an operator ID input when the engine is started as the operator information and may determine the operator based on the output of the imaging device mounted in the cabin 10 and input the determination result. The setting information includes information on the driving mode (for example, whether a low speed high torque mode or a high speed low torque mode has been selected, etc.) and information on the engine setting mode (for example, information on set speed or set horsepower, etc.). The working environment information may include construction information, weather information, or driving surface information, for example, acquired by the imaging device. The driving surface information includes a degree of irregularities on the driving surface or the type of driving surface. The type of driving surface includes "clay", "silt", "sand", "pebble (gravel)", "crude stone", "concrete", "steel plate", and "asphalt". The type of the driving surface may be determined based on the position information of the excavator 100 using geographical information registered in the external server or the like.

As a result, the controller 30 can reduce or prevent the increase/decrease range of the acceleration AC generated when the excavator 100 drives on rough terrain from being expanded, thereby shaking of the operator seated in the driver's seat DS in the front-rear direction being magnified can be reduced or prevented. The operator can easily secure visibility (visualization of the surrounding area) even when the excavator 100 is driving on rough terrain because the expansion of the shaking in the front-rear direction is reduced or prevented.

In the examples of FIG. 6A and FIG. 6B, the controller 30 detects the increase or decrease of the acceleration in the front-rear direction of the upper swing structure 3 as the vibration of the cabin 10. However, the controller 30 may detect the increase or decrease of the pitch angle, the yaw angle, or the roll angle of the upper swing structure 3, the increase or decrease of the acceleration in the left-right direction of the upper swing structure 3, or the increase or decrease of the acceleration in the vertical direction of the upper swing structure 3, as the vibration of the cabin 10. Then, the controller 30 may determine whether a predetermined condition has been satisfied based on the vibration of the detected cabin 10 in this manner. Alternatively, the controller 30 may determine whether the operator's operation of the driving lever 26D is unstable or predicted to be unstable based on the detected vibration of the cabin 10.

As described above, the excavator 100 according to an embodiment of the present disclosure includes the lower traveling structure 1, the upper swing structure 3 mounted on the lower traveling structure 1, the hydraulic driving motor 20 as a driving actuator for moving the lower traveling structure 1, and the controller 30 as a controller for controlling the hydraulic driving motor 20. The controller 30 is configured to detect vibration of the upper swing structure 3 and reduce variation of the driving command value, which is a command value generated when the hydraulic driving motor 20 is operated based on the mode of the vibration.

According to this configuration, the controller 30 can prevent the driving operation by the operator from becoming unstable while the excavator 100 is being driven. Specifically, the controller 30 can reduce the variation of the driving command value which varies according to the operation amount of the driving operation device, for example, when the operation of the driving operation device by the operator is unstable or when it is expected to be unstable. Therefore, the controller 30 can reduce or prevent the disturbance of the driving command value due to unintended movement of the hand caused by vibration of the cabin 10. That is, the controller 30 can reduce or prevent such a disturbance of the driving command value from being reflected in the actual movement of the driving actuator. As a result, the controller 30 can reduce or prevent the vibration of the cabin 10 inevitably generated when driving on rough terrain from being amplified by the disturbance of the driving command value as described above. Further, the controller 30 can reduce or prevent the driving operation by the operator from becoming unstable due to the vibration of the amplified cabin 10.

The controller 30 is typically configured to detect vibration of the upper swing structure 3 based on the output of the inertial sensor S4 mounted on the upper swing structure 3. However, the controller 30 may be configured to detect the vibration of the upper swing structure 3 by predicting the mode of vibration of the upper swing structure 3 based on the output of the inertial sensor mounted on the lower traveling structure 1. Alternatively, the controller 30 may predict the mode of vibration of the upper swing structure 3 based on changes in the surrounding image acquired by an image sensor attached to at least one of the lower traveling structure 1 and the upper swing structure 3, and may predict the mode of vibration of the upper swing structure 3 based on the output such as a tilt sensor or a vibration sensor attached to at least one of the lower traveling structure 1 and the upper swing structure 3. Alternatively, the controller 30 may predict the mode of vibration of the upper swing structure 3 based on the output of a fuel level sensor (a value representing the vertical movement of the float floating in the liquid surface of the fuel in the fuel tank). That is, the controller 30 may be configured to detect the vibration of the upper swing structure 3 by predicting the mode of vibration of the upper swing structure 3 based on the output of other sensors other than an inertial sensor attached to at least one of the lower traveling structure 1 and the upper swing structure 3. According to this configuration, the controller 30 can easily and stably detect the vibration of the upper swing structure 3.

Further, the controller 30 is typically configured to reduce the variation of the driving command value by smoothing the variation of the driving command value. Specifically, the controller 30 is configured to reduce the variation of the driving command value by smoothing the variation of the driving command value by, for example, using a low pass filter. According to this configuration, the controller 30 can control the variation in the driving command values in a timely, simple and rapid manner.

Further, the controller 30 is typically configured to reduce the variation of the driving command value when the continuous driving time exceeds a predetermined time. According to this configuration, the controller 30 can prevent the variation of the driving command value according to a slight operation of the driving operation device by the operator from being reduced, so that the controller 30 can reliably respond to the slight operation of the driving operation device by the operator.

The excavator 100 typically includes the main pump 14 as a hydraulic pump mounted on the upper swing structure 3, the hydraulic driving motor 20 as a driving actuator driven by the hydraulic oil discharged by the main pump 14 to move the lower traveling structure 1, the control valve 171L and the control valve 172R for controlling the flow of the hydraulic oil from the main pump 14 to the hydraulic driving motor 20, and the solenoid valve 31 for controlling the pilot pressure applying to each of the control valves 171L and 172R. The controller 30 is configured to reduce the variation of the driving command value that is a command value to the solenoid valve 31 based on the mode of vibration of the upper swing structure 3. According to this configuration, the controller 30 can prevent the driving operation by the operator from becoming unstable while the excavator 100 is being driven.

The preferred embodiment of the present disclosure has been described in detail above. However, the present disclosure is not limited to the embodiments described above. Various modifications, substitutions, or the like may be applied to the above-described embodiments without departing from the scope of the present disclosure. Further, each of the features described with reference to the embodiments described above may be combined as long as there is no technical conflict.

For example, in the example illustrated in FIG. 5, a hydraulic operating system with a hydraulic pilot circuit related to the left driving lever 26DL is disclosed. In the hydraulic pilot circuit related to the left driving lever 26DL, hydraulic oil supplied from the control pump 15 to the left driving lever 26DL is supplied to the left pilot port of the control valve 171L at a flow rate corresponding to the opening degree of a remote control valve 27 which is opened by tilting in the forward operation direction of the left driving lever 26DL.

However, rather than the hydraulic operating system with such a hydraulic pilot circuit, an electric operation system with an electric operation lever may be employed. In this case, the lever operation amount of the left driving lever 26DL as the electric operation lever is input to the controller 30 as an electrical signal. The solenoid valve is disposed between the control pump 15 and the pilot port of the control valve 171L. The solenoid valve is configured to operate in accordance with the electrical signal from the controller 30. According to this configuration, when a manual operation is performed using the left driving lever 26DL as an electric operation lever, the controller 30 can control the solenoid valve by an electrical signal corresponding to the lever operation amount and move the control valve 171L by increasing or decreasing the pilot pressure applying to the pilot port of the control valve 171L.

Figure 7:
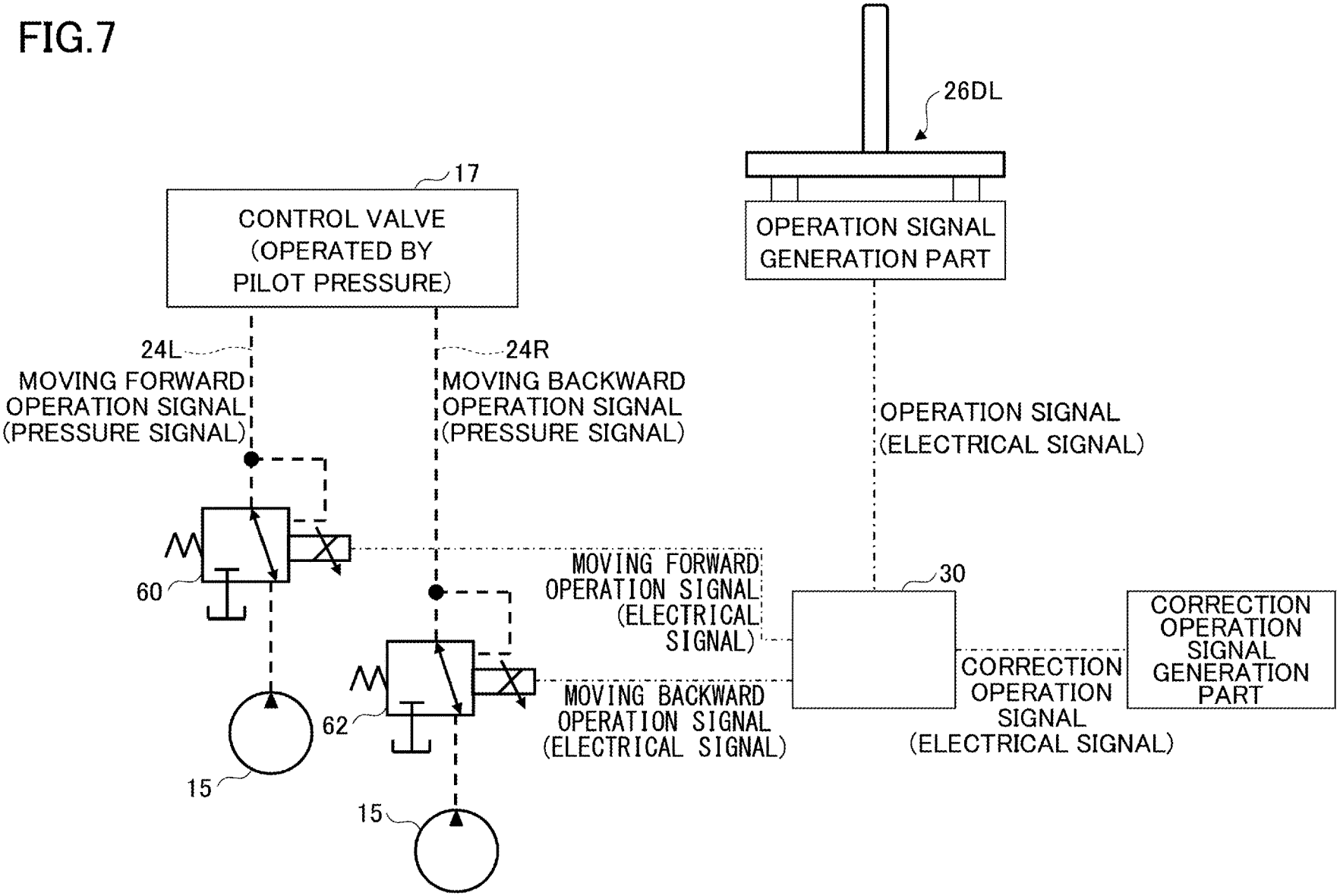
FIG. 7 is a diagram illustrating an example configuration of an electrical operation system.

FIG. 7 illustrates an example configuration of the electrical operation system. Specifically, the electrical operation system of FIG. 7 is an example of a left driving operation system and consists mainly of a control valve 17 operated by pilot pressure (strictly, a control valve included in the control valve 17), the left driving lever 26DL as an electric operation lever, the controller 30, a solenoid valve 60 for a moving forward operation, and a solenoid valve 62 for a moving backward operation. The electrical operation system of FIG. 7 may also be applied to a right driving operation system, a boom operation system, an arm operation system, a bucket operation system, a swivel operation system, and the like.

As illustrated in FIG. 4, the control valve 17 operated by pilot pressure includes a control valve 171L for the left hydraulic driving motor 20L, a control valve 172R for the right hydraulic driving motor 20R, and a control valve 173L for the hydraulic swivel motor 2A, and the like. In the example of FIG. 7, the solenoid valve 60 is configured to adjust the area of the flow path of the pilot line 24L connecting the control pump 15 and the left pilot port of the control valve 171L. The solenoid valve 62 is configured to adjust the area of the flow path of the pilot line 24R connecting the control pump 15 and the right pilot port of the control valve 171L.

Specifically, the controller 30 generates a moving forward operation signal (electrical signal) or a moving backward operation signal (electrical signal) in accordance with an operation signal (electrical signal) output by the operation signal generation part of the left driving lever 26DL. The operation signal output by the operation signal generation part of the left driving lever 26DL is an electrical signal that varies in accordance with the operation amount and the operation direction of the left driving lever 26DL.

The operation signal generation part is an example of the driving command generation part 302 illustrated in FIG. 3, and the operation signal (electrical signal) corresponds to the above-described driving command.

Specifically, when the left driving lever 26DL is operated in the forward operation direction, the controller 30 outputs the moving forward operation signal (electrical signal) in accordance with the lever operation amount to the solenoid valve 60. The solenoid valve 60 adjusts the area of the flow path in accordance with the moving forward operation signal (electrical signal) to control the pilot pressure applying to the left pilot port of the control valve 171L. Similarly, when the left driving lever 26DL is operated in the backward operation direction, the controller 30 outputs the moving backward operation signal (electrical signal) in accordance with the lever operation amount to the solenoid valve 62. The solenoid valve 62 adjusts the area of the flow path in accordance with the moving backward operation signal (electrical signal) to control the pilot pressure applying to the right pilot port of the control valve 171L.

When smoothing the operation signal output by the operation signal generation part of the left driving lever 26DL, the controller 30 generates, for example, the moving forward operation signal (electrical signal) or the moving backward operation signal (electrical signal) in accordance with the correction operation signal (electrical signal) instead of the operation signal output by the operation signal generation part of the left driving lever 26DL. The correction operation signal may be an electrical signal generated by the controller 30 or an electrical signal generated by an external controller other than the controller 30.

What is claimed is:

1. An excavator comprising:

a lower traveling structure;

an upper swing structure mounted on the lower traveling structure;

a traveling actuator configured to move the lower traveling structure;

a cabin provided on the upper swing structure;

a driver's seat disposed in the cabin; and a controller including a memory and a processor coupled to the memory and configured to control the traveling actuator, and determine that a traveling operation is unstable or is expected to be unstable due to vibration in response to determining that an increase and decrease of an acceleration in a front-rear direction of the upper swing structure or the driver's seat has been repeated a predetermined number of times or more during traveling of the excavator, wherein the processor is further configured to determine whether the excavator is traveling;

determine whether a continuous traveling time exceeds a predetermined time, the continuous traveling time being a period during which the excavator is determined to be traveling, and reduce variation of a command value for driving the traveling actuator in response to determining that the traveling operation is unstable or is expected to be unstable and that the continuous traveling time exceeds the predetermined time.

2. The excavator according to claim 1, wherein the processor is further configured to determine that the traveling operation is unstable or is expected to be unstable due to the vibration based on an output of a sensor attached to the upper swing structure, the lower traveling structure, or the driver's seat.

3. The excavator according to claim 1, wherein the processor is further configured to reduce the variation of the command value by smoothing the variation of the command value.

4. The excavator according to claim 3, wherein the processor is configured to smooth the variation of the command value by applying a low pass filter to the command value, limiting a variation rate of the command value, setting an upper limit to the command value, setting a lower limit to the command value, applying a bandpass filter to the command value, or changing a control gain for the command value.

5. The excavator according to claim 1, further comprising:

a hydraulic pump mounted on the upper swing structure;

a hydraulic traveling motor driven by hydraulic oil discharged by the hydraulic pump, the hydraulic traveling motor being the traveling actuator configured to move the lower traveling structure;

a control valve configured to control a flow of the hydraulic oil from the hydraulic pump to the hydraulic traveling motor; and a solenoid valve configured to control a pilot pressure applied to the control valve, wherein the processor is further configured to reduce the variation of the command value with respect to the solenoid valve.

6. The excavator according to claim 1, wherein the processor is further configured to determine whether the excavator is traveling, and the processor is configured to determine that the traveling operation is unstable or is expected to be unstable due to the vibration in response to determining that the excavator is traveling and that the increase and decrease of the acceleration in the front-rear direction of the upper swing structure or the driver's seat has been repeated the predetermined number of times or more during the traveling of the excavator.

* * * * *